US006430762B1

(12) United States Patent
Cheng

(10) Patent No.: US 6,430,762 B1
(45) Date of Patent: Aug. 13, 2002

(54) BABY PLAYPEN-BASSINET COMBINATION

(76) Inventor: Kenny Cheng, No. 16, Lane 47, Chih Feng St., Taipei (TW)

( * ) Notice: Subject to any disclaimer, the term of this patent is extended or adjusted under 35 U.S.C. 154(b) by 0 days.

(21) Appl. No.: 09/748,494

(22) Filed: Dec. 22, 2000

(51) Int. Cl.[7] ..... A47D 13/06
(52) U.S. Cl. ..... 5/93.2; 5/98.3; 5/99.1
(58) Field of Search ..... 5/93.2, 98.1, 98.3, 5/97, 99.1

(56) References Cited

U.S. PATENT DOCUMENTS 4,967,432 A * 11/1990 Kujawski et al. ..... 5/122
5,163,191 A * 11/1992 Chan ..... 24/387
5,553,336 A * 9/1996 Mariol ..... 5/93.1
5,615,427 A * 4/1997 Huang ..... 5/98.1
5,778,465 A * 7/1998 Myers ..... 5/93.1
5,991,944 A * 11/1999 Yang ..... 403/231
6,233,759 B1 * 5/2001 Warner et al. ..... 5/93.1

* cited by examiner

*Primary Examiner*—Michael F. Trettel
(74) *Attorney, Agent, or Firm*—Harness, Dickey & Pierce, P.L.C.

(57) ABSTRACT

A baby playpen-bassinet combination comprising a playpen and a bassinet detachably mounted to the playpen. The playpen comprises two outer fabric sides with connecting members and four corner blocks. Each corner block is provided with a vertical hole and a vertically extending rib. The bassinet comprises two extension portions with connecting members engageable with the connecting members of the playpen, two supporting rods and four coupling members. Each coupling member has a first portion to be inserted into a hollow end portion of the supporting rod and a second portion having a vertically extending groove. The second portion is adapted to be inserted into the vertical hole of the corner block with the groove engaging the rib so that each supporting rod is supported on two corner blocks.

14 Claims, 5 Drawing Sheets

BABY PLAYPEN-BASSINET COMBINATION

BACKGROUND OF THE INVENTION

1. Field of the Invention

This invention relates generally to a combination of a baby playpen and a baby bassinet, and more particularly to a baby playpen-bassinet combination in which a baby bassinet is safely and stably suspended from the top of a baby playpen by a simple and inexpensive mechanism.

2. Description of the Prior Art

Many types of baby playpen-bassinet combinations are currently available on the market. These baby playpen-bassinet combinations are different from one another mainly in the mechanism by which the baby bassinet is mounted onto the baby playpen. FIG. 1 shows a prior art combination of a baby playpen 30 and a baby bassinet 40. The baby playpen 30 includes an upper frame 31, a bottom frame 32, a supporting frame 33 and a fabric body 35. The upper frame 31 are provided with four corner blocks 34 at four corners thereof. The supporting frame 33 connects corresponding corners of the upper frame 31 and the bottom frame 32 by being fixed to the corner blocks 34. The fabric body 35 is supported by the upper frame 31 and the supporting frame 33 so as to surround the periphery of the playpen 30 and cover the bottom frame 32. The baby bassinet 40 is formed by stitching a fabric 41. The four corners of the bassinet 40 are cut away for mating with the corner blocks 34 of the playpen 30. A number of hooks 42 are arranged along the top edge of the bassinet 40. By hanging the hooks 42 of the bassinet 40 on the upper frame 31 of the playpen 30, the bassinet 40 can be suspended from the top edge of the playpen 30 so that the bottom of the bassinet 40 is received within the playpen 30.

With the bassinet 40 having the structure described above, since the hooks 42 have to be sufficiently strong in order to prevent from breakage during the use thereof, the hooks 42 are usually formed from plastic steel material which is relatively expensive. In addition, since the relatively rigid hooks 42 are connected with the much softer fabric 41, after the bassinet 40 is used for a certain period of time, the fabric 41 often tears in the vicinity of the hooks 42 resulting in safety problems.

A baby playpen-bassinet combination developed to overcome the above mentioned problems in the prior art has been described in the U.S. patent application Ser. No. 09/632,148 filed on Aug. 3, 2000, by this inventor. Nevertheless, there still exits a need for a baby playpen-bassinet combination in which a baby bassinet is even more safely and stably suspended from the top of a baby playpen by a mechanism which is relatively inexpensive to manufacture.

SUMMARY OF THE INVENTION

An object of the present invention is therefore to provide a baby playpen-bassinet combination in which a baby bassinet is safely and stably mounted onto the top of a baby playpen by simple and inexpensive means.

To achieve the above object, the present invention provides a baby playpen-bassinet combination comprising a playpen including an upper frame, a supporting frame, a bottom frame and a fabric body, and a bassinet detachably mounted onto the upper frame of the playpen and including a main body, two suspension sleeve, two extension portions, two supporting rods, four coupling members and a bottom plate. The upper frame includes two horizontal longitudinal rods parallel to each other, two horizontal lateral rods parallel to each other and perpendicular to the two longitudinal rods and four corner blocks. Each of the four corner blocks fixedly connects one of the two longitudinal rods and one of the two lateral rods and is provided with a vertical hole and a vertically extending rib radially inwardly protruded from the wall of the vertical hole. The supporting frame is fixedly connected to the four corner blocks of the upper frame. The bottom frame is fixedly connected to the supporting frame. The fabric body wraps around the two longitudinal rods, the two lateral rods and the supporting frame so as to form a peripheral surface of the playpen and covers the bottom frame. The peripheral surface includes two lateral outer fabric sides extending downwards from the two lateral rods, respectively, and provided with first connecting means, respectively. The main body of the bassinet is received within a space defined by the two longitudinal rods and the two lateral rods of the playpen. The main body includes two longitudinal sides parallel to each other, two lateral sides parallel to each other and perpendicular to the two longitudinal dies and a bottom. The two suspension sleeves are connected to the two longitudinal sides of the main body so as to extend longitudinally, respectively. The two extension portions are connected to the two lateral sides of the main body so as to extend therefrom, respectively, and provided with second connecting means engageable with the first connecting means of the playpen, respectively. The two extension portions extend around the two lateral rods of the playpen, respectively, so as to be fixedly connected to the two lateral outer fabric sides of the peripheral surface of the playpen, respectively, through engagement between the first and second connecting means. The two supporting rods pass through the two suspension sleeves, respectively, so that two hollow end portions of each of the two supporting rods are protruded outside of the sleeve. Each of the coupling members has a horizontally extending first portion and a vertically extending second portion integrally formed with and extending downwards from an end of the first portion. The first portion is to be inserted into the hollow end portion of the supporting rod. The second portion has a radially inwardly recessed groove vertically extending upwards from a bottom thereof. The second portion is adapted to be inserted into the vertical hole of the corner block with the vertically extending groove engaging the vertically extending rib so that each supporting rod is supported on two corner blocks.

Preferably, the vertically extending rib and the vertically extending groove are located such that the vertically extending rib engages the vertically extending groove in a plane formed by the first and second portions of the coupling member when the second portion of the coupling member is inserted into the vertical hole of the corner block.

Preferably, the vertically extending groove is provided in the second portion of the coupling member on the same side as the first portion, and the second portion of the coupling member further comprises an resilient portion connected to the bottom of the second portion on an opposite side to the first portion and extending upwards from the bottom of the second portion in parallel with the second portion. The resilient portion is provided at a top thereof with a pressing portion obliquely extending to a level higher than that of the first portion so that pressing the pressing portion of the resilient portion causes the resilient portion to move towards the second portion of the coupling member, thereby facilitating the removal of the coupling member from the vertical hole.

Preferably, the corner blocks are formed from plastic or metal material, the supporting rods are formed from metal material such as iron and the coupling members are formed from plastic material.

The above and other objects, features, aspects and advantages of the present invention will become apparent to those skilled in the art from the following detailed description, which, taken in conjunction with the accompanying drawings, discloses a preferred embodiment of the present invention.

DETAILED DESCRIPTION OF THE PREFERRED EMBODIMENT

A preferred embodiment of a baby playpen-bassinet combination according to the present invention will be described in the following with reference to FIGS. 2 to 4. Since baby playpens and bassinets are well known, the following description will be directed in particular to elements or features of the baby playpen-bassinet combination of the present invention which are different from those of prior art. It is to be understood that elements or constructions thereof not specifically shown or described may take various forms well known to those skilled in the art.

Figure 1:
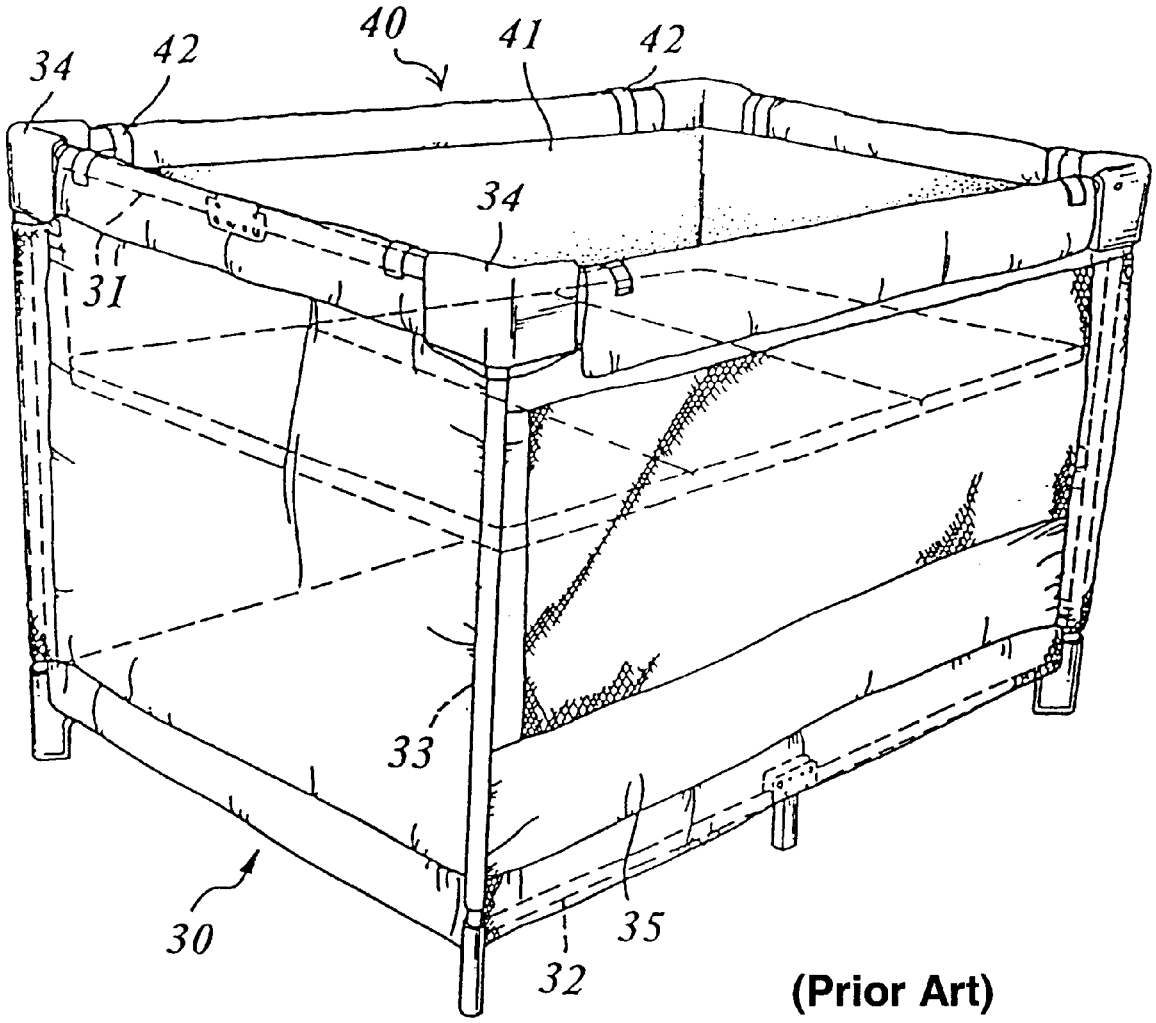
FIG. 1 is a perspective view showing a prior art baby playpen-bassinet combination.
Figure 2:
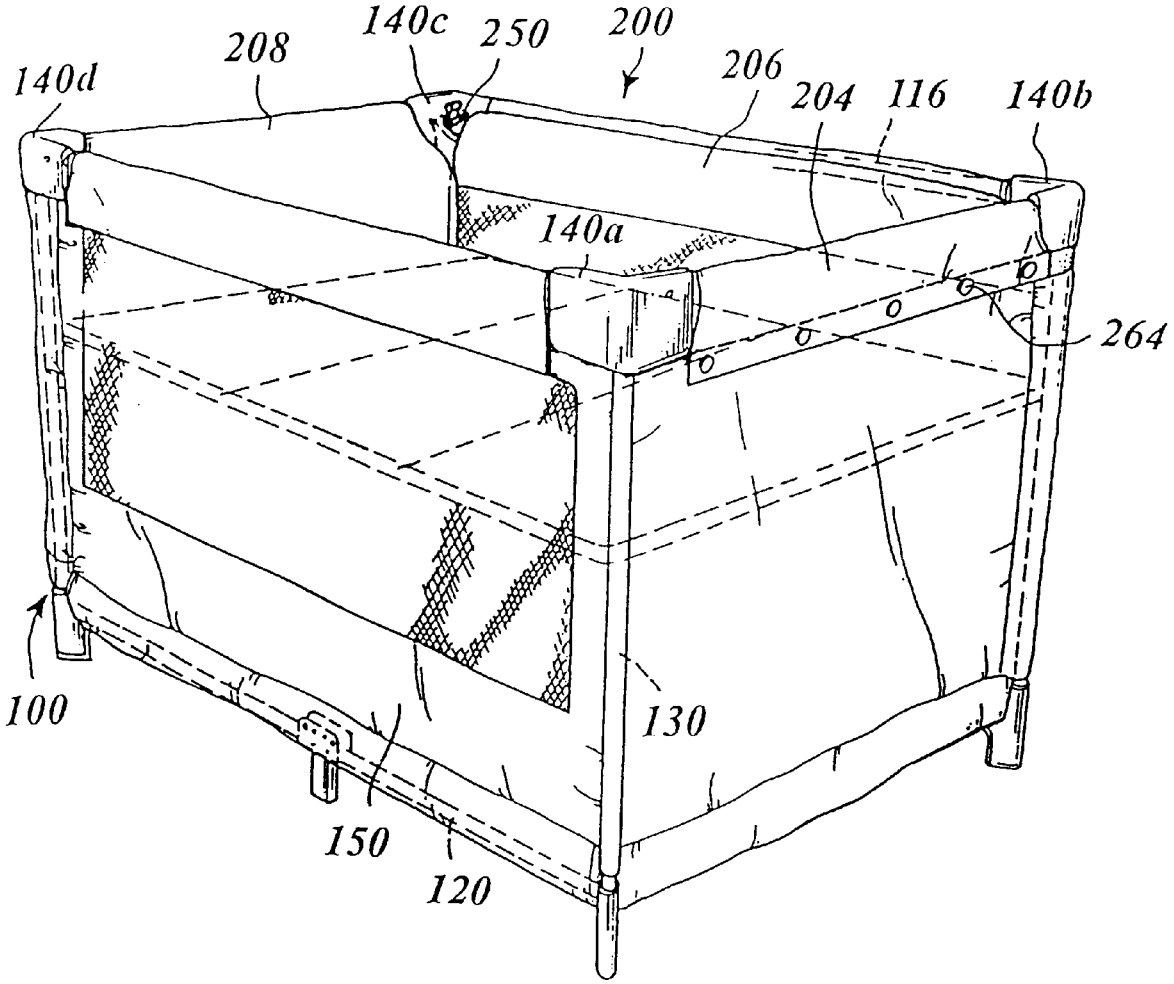
FIG. 2 is an assembled perspective view showing a preferred embodiment of a baby playpen-bassinet combination according to the present invention.
Figure 3:
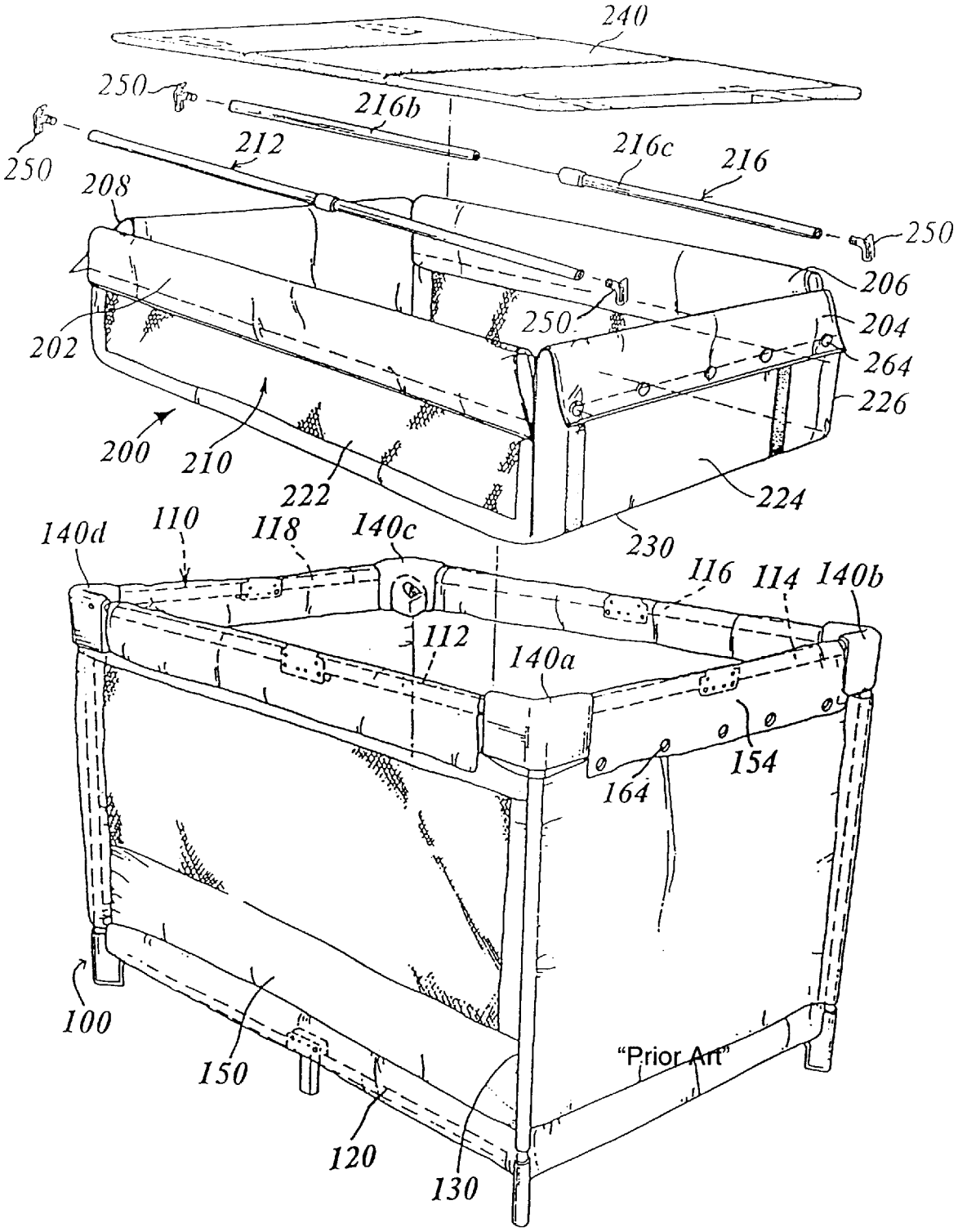
FIG. 3 is an exploded perspective view showing the baby playpen-bassinet combination of FIG. 2.

With reference to FIGS. 2 and 3, FIG. 2 is an assembled perspective view showing a preferred embodiment of the baby playpen-bassinet combination according to the present invention, and FIG. 2 is an exploded perspective view showing the playpen-bassinet combination of FIG. 2. As shown in FIGS. 2 and 3, the baby playpen-bassinet combination comprises a playpen 100 and a bassinet 200 detachably mounted on and suspended from the top of the playpen 100 and received within the playpen 100.

The playpen 100 includes an upper frame 110, a bottom frame 120, a supporting frame 130 and a fabric body 150. The upper frame 110 includes a first horizontal longitudinal rod 112 and a second horizontal longitudinal rod 116 parallel to each other in a longitudinal direction of the playpen 100, a first horizontal lateral rod 114 and a second horizontal lateral rod 118 perpendicular to the first and second horizontal longitudinal rods 112 and 116 and parallel to each other in a lateral direction of the playpen 100, and four corner blocks 140*a*, 140*b*, 140*c* and 140*d* for fixedly connecting two of the aforementioned horizontal rods, respectively. As shown in FIGS. 2 and 3, the corner block 140*a* fixedly connects the first longitudinal rod 112 and the first lateral rod 114, the corner blocks 140*b* fixedly connects the first lateral rod 114 and the second longitudinal rod 116, the corner block 140*c* fixedly connects the second longitudinal rod 116 and the second lateral rod 118 and the corner block 140*d* fixedly connects the second lateral rod 118 and the first longitudinal rod 112. As well known in the art the rods 112, 114, 116 and 118 and the corner blocks 140*a* to 140*d* of the upper frame 110 may be formed from any suitable plastic or metal material. Furthermore, since the connections between the rods 112, 114, 116 and 118 and the corner blocks 140*a* to 140*d* are well known to those skilled in the art, they will not be further discussed or illustrated in detail herein.

Figure 4A:
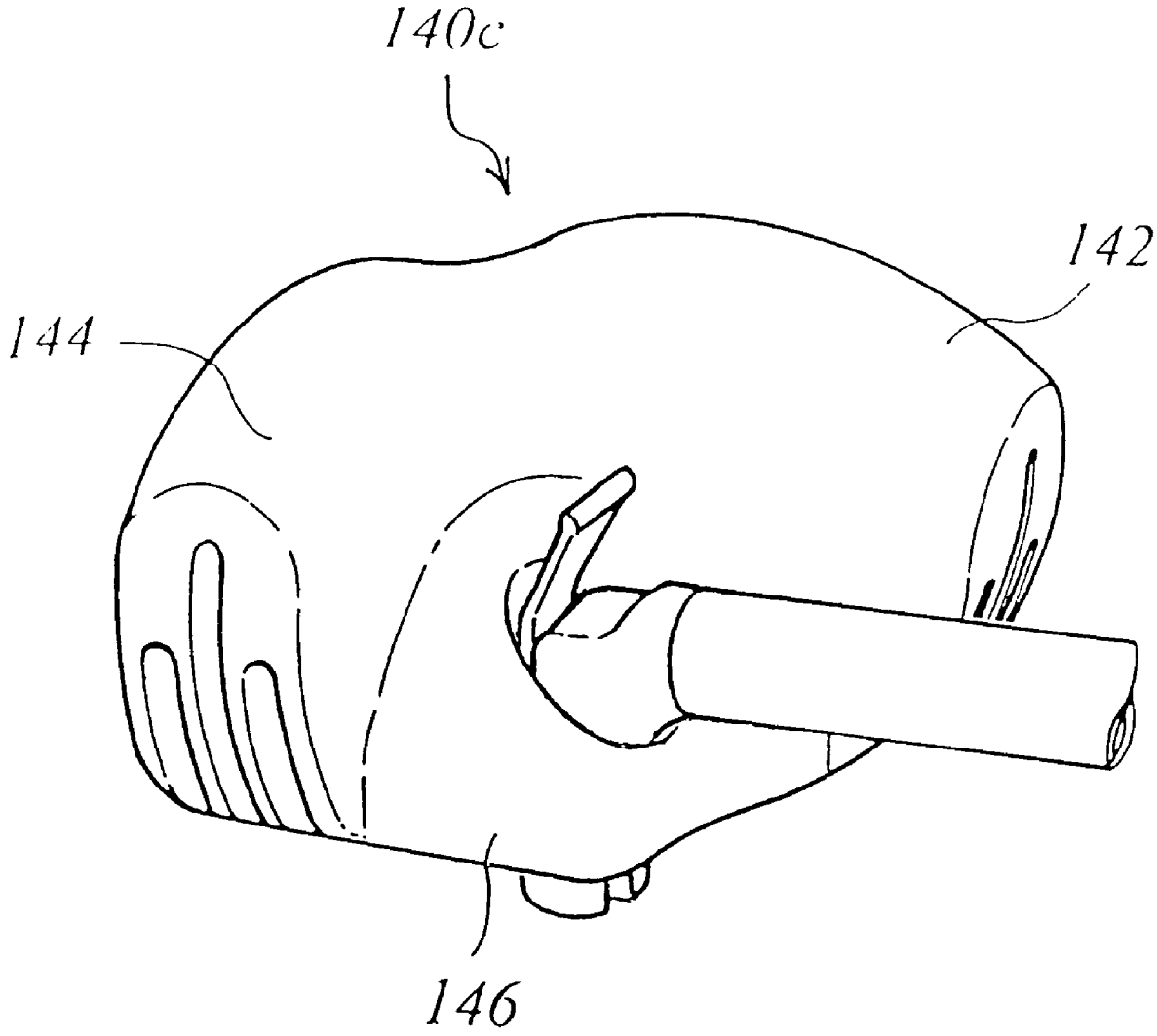
FIGS. 4A and 4B are enlarged assembled and exploded perspective views of a corner block of the playpen and a portion of a supporting rod and a coupling member of the bassinet of the baby playpen-bassinet combination of FIGS. 2 and 3, respectively.
Figure 4B:
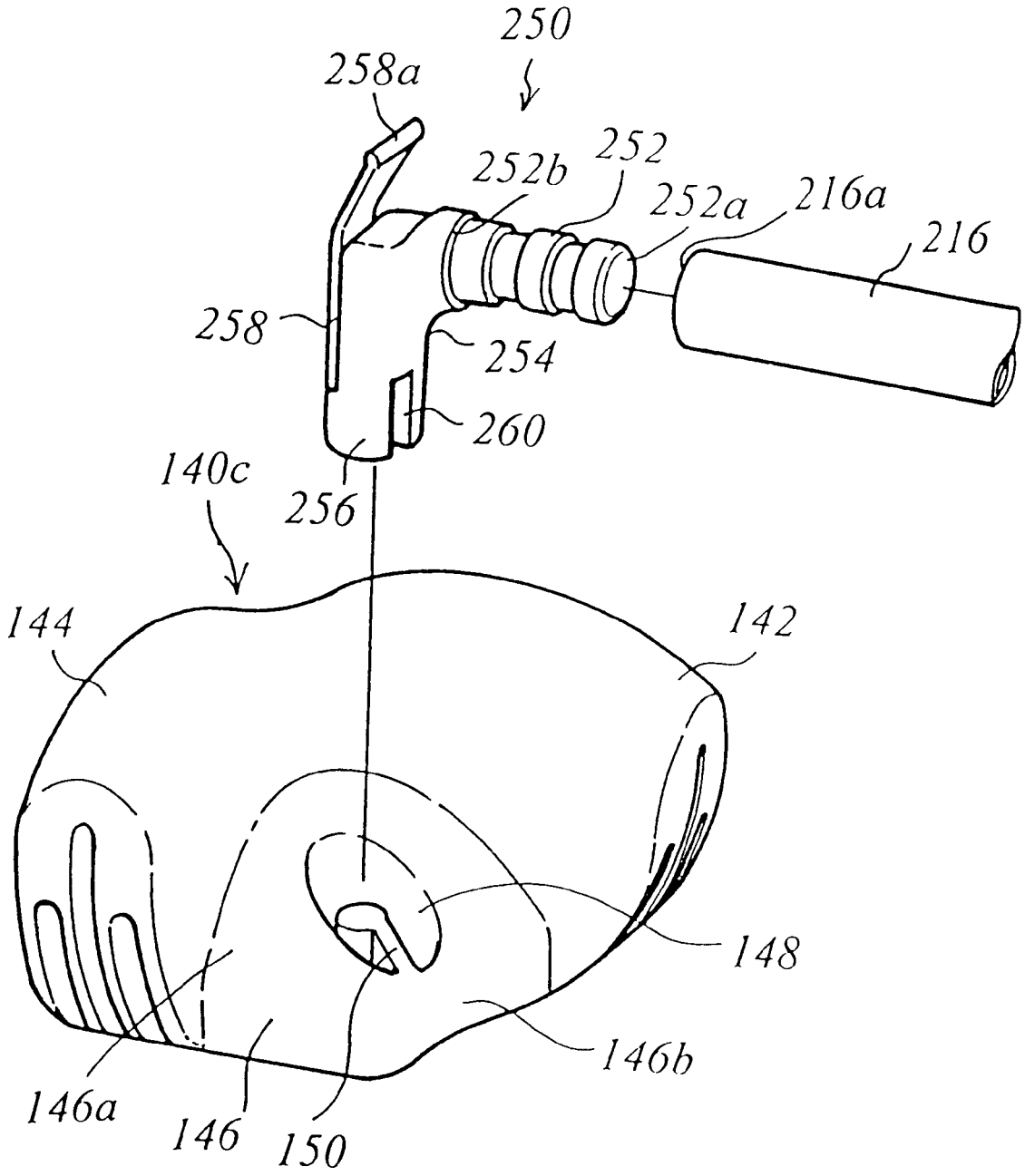

The playpen 100 of the illustrated embodiment of the baby playpen-bassinet combination according to the present invention is different from the prior art playpen mainly in the structure of the corner blocks 140*a* to 140*d*. As best seen in FIGS. 4A and 4B, in this embodiment, the corner block 140*c*, for example, includes a longitudinal portion 142 extending in the longitudinal direction of the playpen 100 for fixedly connecting the second longitudinal rod 116, a lateral portion 144 integrally perpendicularly extending from the longitudinal portion 142 in the lateral direction of the playpen 100 for fixedly connecting the second lateral rod 118, and a protruded portion 146 integrally inwardly protruded between a lower portion of the longitudinal portion 142 and a lower portion of the lateral portion 144. The protruded portion 146 is provided with a vertical hole 148 and a vertically extending rib 150 radially inwardly protruded from the wall of the vertical hole 148. In addition, in this embodiment, the top portion of the protruded portion 146 is inclined downwards from a connecting portion 146*a* integrally connected to the lateral portion 144 to an edge portion 146*b* in the longitudinal direction of the playpen 100, and the vertically extending rib 150 is inwardly protruded from the wall portion of the vertical hole 148 on the side of the edge portion 146*b* in a radial direction of the vertical hole 148 substantially in parallel with the longitudinal portion 142. Moreover, as shown in FIG. 4B, in this embodiment, the vertically extending rib 150 upwardly extends slightly beyond the top of the edge portion 146*b* of the protruded portion 146. This arrangement effectively prevents babies from intentionally or inadvertently inserting their fingers from above into the vertical hole 148. Likewise, each of the corner blocks 140*a*, 140*b* and 140*d* is constructed in the same manner as the corner block 140*c*. Of course, it will be apparent to those skilled in the art from this disclosure that the vertical hole 148 may be a vertical blind hole or a vertical through hole. In the case of the vertical hole 148 being a blind hole, the vertically extending rib 150 may be integrally formed with and upwardly extend from the bottom portion of the vertical hole 148. In the case of the vertical hole 148 being a through hole, it is desirable that the vertically extending rib 150 extends down to the lowest portion of the wall of the vertical hole 148. This arrangement effectively prevents babies from intentionally or inadvertently inserting their fingers from below into the vertical hole 148. Also, it will be apparent to those skilled in the art from this disclosure that the top portion of the protruded portion 146 may horizontally extend without any inclination, provided that they can achieve their functions which will be described in detail later. Of course, in this case, the upper end of the vertically extending rib 150 may be flush with rather than protruded beyond the top portion of the protruded portion 146. FIGS. 4A and 4B also show a portion of one of the supporting rods of the bassinet 200 and a coupling member of the bassinet 200 for connecting the supporting rod and a corner block as will be described in detail later.

With reference to FIGS. 2 and 3 again, the supporting frame 130 includes four vertical rods fixedly connected to the corner blocks 140*a* to 140*d*, respectively. The four vertical rods of the supporting frame 130 connect the upper frame 110 and the bottom frame 120 at respective corners by being fixedly connected to the corner blocks 140*a* to 140*d*. The bottom frame 120 may take any form, provided that it can be connected to the vertical rods of the supporting frame 130 to firmly and stably support the playpen 100 on the ground. Since the precise structure of the supporting frame 130, the bottom frame 120 or the connection therebetween is not critical to the present invention, the structure of the supporting frame 130 or the bottom frame 120 will not be further described or illustrated in detail herein.

The fabric body 150 wraps around the horizontal rods 112, 114, 116 and 118 of the upper frame 110 and the vertical rods of the supporting frame 130 so as to be supported by the upper frame 110 and the supporting frame 130 to form the peripheral surface of the playpen 100 and to cover the bottom frame 120. As shown in FIG. 3, the fabric body 150 wraps around the first and second longitudinal rods 112 and 116 to form the first and second longitudinal top edges of the playpen 100, respectively, and around the first and second lateral rods 114 and 118 to form the first and second lateral top edges of the playpen 100, respectively. Since the manner by which the fabric body 150 wraps around and is supported by the respective horizontal and vertical rods is well know to those skilled in the art, it will not be further discussed or illustrated in detail herein.

The peripheral surface of the playpen 100, which is formed by the fabric body 150, includes a first lateral outer fabric side 154 extending downwards from the first lateral top edge (i.e., the first lateral rod 114) of the playpen 100, and a second lateral outer fabric side (not shown) extending downwards from the second lateral top edge (i.e., the second lateral rod 118) of the playpen 100. As shown in FIG. 3, in this embodiment, as connecting means, five snap button female members 164 linearly aligned in the lateral direction of the playpen 100 are provided on the first lateral outer fabric side 154 at a position away from the first lateral top edge of the playpen 100 by a predetermined distance. Likewise, although not shown in the figures, five snap button female members linearly aligned in the lateral direction of the playpen 100 are also provided, as connecting means, on the second lateral outer fabric side at a position away from the second lateral top edge of the playpen 100 by the same predetermined distance. Of course, it will be apparent to those skilled in the art from this disclosure that the connecting means is not limited to the snap buttons, and any other connecting structure may be used to replace the snap buttons as connecting means. Also, it will be apparent to those skilled in the art from this disclosure that the number of the snap button female members is not limited to five but may be more or less, and the arrangement of the female members is not limit to be linear in the lateral direction of the playpen, provided that the function which will described in detail later can be achieved thereby.

Next, the structure of the baby bassinet 200 of the preferred embodiment of the baby playpen-bassinet combination according to the present invention will be described by mainly referring to FIG. 3. As shown in FIG. 3, the bassinet 200 includes a main body 210, first and second suspension sleeves 202 and 206, first and second extension portions 204 and 208, first and second supporting rods 212 and 216, four coupling members 250 and a bottom plate 240. Preferably. the main body 210, the first and second suspension sleeves 202 and 206 and the first and second extension portions 204 and 208 of the bassinet 200 are integrally formed by stitching a fabric. It goes without saying that the longitudinal and lateral directions of the bassinet 200 correspond to the longitudinal and lateral directions of the playpen 100, respectively.

As shown in FIG. 3, the main body 210 of the bassinet 200 is integrally formed with a first longitudinal side 222 and a second longitudinal side 226 parallel to each other, a first lateral side 224 and a second lateral side (not shown) parallel to each other and perpendicular to the first and second longitudinal sides 222 and 226 and a bottom 230. The first suspension sleeve 202 of the bassinet 200 is integrally connected to the top edge of the first longitudinal side 222 of the main body 210 and extends in the longitudinal direction of the bassinet 200 substantially over the entire longitudinal length of the bassinet 200. Likewise, the second suspension sleeve 206 is integrally connected to the top edge of the second longitudinal side 226 of the main body 210 and extends in the longitudinal direction of the bassinet 200 substantially over the entire longitudinal length of the bassinet 200.

In this embodiment, the first extension portion 204 of the bassinet 200 is integrally connected at one edge thereof to the top edge of the first lateral side 224 of the main body 210 with the other edge opposite to the connected edge being a free edge. In the vicinity of the free edge of the first extension portion 204, five snap button male members 264 linearly aligned in the lateral direction of the bassinet 200 and protruded towards the bottom 230 of the main body 210 when the first extension portion 204 is horizontally pulled outwardly of the bassinet 200 are provided as connecting means engageable with the connecting means of the playpen 100 described above.

Likewise, the second extension portion 208 of the bassinet 200 is integrally connected at one edge thereof to the top edge of the second lateral side of the main body 210 with the other edge opposite to the connected edge being a free edge. Although not shown in the figures, in the vicinity of the free edge of the second extension portion 208, five snap button male members linearly aligned in the lateral direction of the bassinet 200 and protruded towards the bottom 230 of the main body 210 when the second extension portion 208 is horizontally pulled outwardly of the bassinet 200 are also provided as connecting means engageable with the connecting means of the playpen 100 described above. As will be described in detail later when the bassinet 200 is mounted on the top of the playpen 100, the five snap button male members 264 of the first extension portion 204 and the five snap button male members of the second extension portion 208 of the bassinet 200 engages with the five snap button female members 164 of the first lateral outer fabric side 154 and the five snap button female members of the second lateral outer fabric side of the playpen 100, respectively.

The first supporting rod 212 of the bassinet 200 has two hollow end portions 212*a*. In addition, the size and length of the first supporting rod 212 are designed such that the rod 212 can pass through the first suspension sleeve 202 of the bassinet 200 easily with the two hollow end portions 212*a* thereof protruded out of respective ends of the sleeve 202. Likewise, the second supporting rod 216 of the bassinet 200 has two hollow end portions 216*a*, and the size and length of the second supporting rod 216 are designed such that the rod 216 can pass through the second suspension sleeve 206 of the bassinet 200 easily with the two hollow end portions 216*a* thereof protruded out of respective ends of the sleeve 206. As will be described in detail later, each of the hollow end portions 212*a* and 216*a* of the first and second supporting rods 212 and 216 is designed to receive a portion of the coupling member 250.

In this embodiment, as shown in FIG. 3, the second supporting rod 216 consists of a first rod section 216*b* and a second rod section 216*c*. The first rod section 216*b* has at one end thereof the hollow end portion 216*a* and at the other end thereof a free end. The second rod section 216*c* has at one end thereof the hollow end portion 216*a* and at the other end thereof a large diameter portion for receiving the free end of the first rod section 216*b* so as to form the complete second supporting rod 216. Likewise, the first supporting rod 212 has the same structure. In FIG. 3, the second supporting rod 216 is shown in a state that the first and second rod sections 216*b* and 216*c* thereof are separate, while the first supporting rod 212 is shown in an assembled state. Such a two-section design facilitates the assembling and storage of the playpen-bassinet combination. Of course, it will be apparent to those skilled in the art from this disclosure that the structure of the supporting rod is not limited to such a two-section design. Instead, the supporting rod may be a single rod piece or may consist of more than two rod sections, provided that the function thereof can be achieved. The supporting rod may be formed from any suitable metal material, such as iron.

Next, the coupling member 250 will be described in detail with reference to FIGS. 4A and 4B. Although only the coupling member 250 for connecting the corner block 140*c* and one of the hollow end portions 216*a* of the second supporting rod 216 is illustrated in FIGS. 4A and 4B, it will be apparent to those skilled in the art from this disclosure that the following description applies to other three coupling members 250 as well. As shown in FIG. 4B, the coupling member 250 is substantially L-shaped and comprises a horizontally extending first portion 252 and a vertically extending second portion 254 integrally formed with and extending downwards from an end of the first portion 252. The first portion 252 of the coupling member 250 has an insertion portion 252*a* adapted to be inserted into the hollow end portion 216*a* of the supporting rod 216, and an abutment portion 252*b* adapted to abut against the rim of the end face of the hollow end portion 216*a* when the insertion portion 252*a* is inserted into the hollow end portion 216*a* . As shown in FIG. 4A, the second portion 254 of the coupling member 250 is sized and configured to be inserted into the vertical hole 148 of the corner block 140*c* of the playpen 100. For this purpose, as shown in FIG. 4B, in this embodiment, the second portion 254 of the coupling member 250 includes a body portion 256 which at a top thereof is integrally formed with and perpendicularly connected to the first portion 252, and a resilient portion 258 which is connected to the bottom portion of the body portion 256 on the side opposite to the first portion 252 and upwardly extends in parallel with the body portion 256. Moreover, in this embodiment, in the body portion 256 of the second portion 254 of the coupling member 250 on the same side as the first portion, a vertically extending groove 260 radially recessed into the body portion 256 and vertically extending form the bottom of the body portion 256 is provided under the first portion 252. When the second portion 254 of the coupling member 250 is inserted into the vertical hole 148 of the corner block 140*c*, the vertically extending groove 260 in the second portion 254 engages the vertically extending rib 150 of the corner block 140*c*. In addition, in this embodiment, as shown in FIG. 4B, the resilient portion 258 is provided at an upper end thereof with a pressing portion 258*a* which obliquely extends to a level higher than that of the first portion 252. As shown in FIG. 4A, the resilient portion 258 having the pressing portion 258*a* is designed such that the pressing portion 258*a* is exposed to the outside of the vertical hole 148 in the corner block 140*c* when the second portion 254 of the coupling member 250 is inserted into the vertical hole 148. Thus, pressing the inclined pressing portion 258*a* causes the resilient portion 258 to move towards the body portion 256 of the second portion 254, thereby facilitating the removal of the coupling member 250 from the vertical hole 148 in the corner block 140*c*. The coupling member 250 is preferably integrally molded from plastic material.

The following description is directed to the mounting operation of suspending the bassinet 200 from the top of the playpen 100 according to the preferred embodiment of the baby playpen-bassinet combination of the present invention.

First, respective rod sections are connected to form the complete first and second supporting rods 212 and 216 of the bassinet 200. Then, the first supporting rod 212 is inserted through the first suspension sleeve 202 of the bassinet 200 until the two hollow end portions 212*a* thereof are protruded out of respective ends of the sleeve 202. The insertion portion 252*a* of the first portion 252 of a coupling member 250 is then inserted into one of the hollow end portions 212*a* of the first supporting rod 212 until the rim of the end face of the hollow end portion 212*a* abuts against the abutment portion 252*b* of the first portion 252 of the coupling member 250. Likewise, the insertion portion 252*a* of another coupling member 250 is inserted into the other hollow end portion 212*a* of the first supporting rod 212 until the rim of the end face of the hollow end portion 212*a* abuts against the abutment portion 252*b* of the coupling member 250. Since the total length of the first supporting rod 212 with the two coupling members 250 inserted into the two hollow end portions 212*a* thereof is set to correspond to the distance between the vertical holes 148 in the corner blocks 140*a* and 140*d* of the playpen 100, the second portions 254 of the two coupling members 250 inserted into the two hollow end portions 212*a* of the first supporting rod 212 can then be easily and conveniently inserted into the vertical holes 148 in the corner blocks 140*a* and 140*d*, respectively, with the vertically extending rib 150 of the corner block engaging the vertically extending groove 260 of the coupling member 250. By this, the first supporting rod 212 is supported on the corner blocks 140*a* and 140*d* of the playpen 100 so that the first longitudinal side 222 of the main body 210 of the bassinet 200 is suspended from the first supporting rod 212 through the first suspension sleeve 202.

Next, the second supporting rod 216 is inserted through the second suspension sleeve 206 of the bassinet 200 until the two hollow end portions 216*a* thereof are protruded out of respective ends of the sleeve 206. Likewise, the insertion portions 252*a* of the first portions 252 of two coupling members 250 are inserted into the two hollow end portions 216*a* of the second supporting rod 216, respectively, until the abutment portions 252*b* abut against the rims of the end faces of the hollow end portions 216*a*. Since the total length of the second supporting rod 216 with the two coupling members 250 inserted into the two hollow end portions 216*a* thereof is set to correspond to the distance between the vertical holes 148 in the corner blocks 140*b* and 140*c* of the playpen 100, the second portions 254 of the two coupling members 250 inserted into the two hollow end portions 216*a* of the second supporting rod 216 can then be easily and conveniently inserted into the vertical holes 148 in the corner blocks 140*b* and 140*c*, respectively, with the vertically extending rib 150 engaging the vertically extending groove 260 of the coupling member 250. By this, the second supporting rod 216 is supported on the corner blocks 140*b* and 140*c* of the playpen 100 so that the second longitudinal side 226 of the main body 210 of the bassinet 200 is suspended from the second supporting rod 216 through the second suspension sleeve 206.

As described above, the top portion of the protruded portion 146 of each of the corner blocks 140*a* to 140*d* is inclined downwards from the lateral portion 144 of the corner block in the longitudinal direction. Thus, it is not only easy to insert the second portions 254 of the coupling members 250 having been inserted into the hollow end portions 212*a* and 216*a* of the supporting rods 212 and 216 into the vertical holes 148, but also the coupling members 250 inserted into the vertical holes 148 can be stably retained from both sides thereof by the inclined top portion of the protruded portion 146 without wobbling in the lateral direction. In addition as described above, when the second portion 254 of the coupling member 250 is inserted into the vertical hole 148, the pressing portion 258*a* at the upper end of the resilient portion 258 of the second portion 254 is exposed to the outside of the vertical hole 148, thereby facilitating the removal of the coupling member 250 from the vertical hole 148.

Then, the first extension portion 204 of the bassinet 200 is pulled outwards around the first lateral top edge, i.e., the first lateral rod 114 wrapped with the fabric body 150, of the playpen 100, so that it extends downwards in parallel with the first lateral outer fabric side 154 of the playpen 100 until the five snap button male members 264 provided on the first extension portion 204 face the five snap button female members 164 provided on the first lateral outer fabric side 154. Then, the five snap button male members 264 of the bassinet 200 can be engaged with the five snap button female members 164 of the playpen 100. By such engagement, the first lateral side 224 of the main body 210 of the bassinet 200 is suspended from the first lateral top edge of the playpen 100 through the first extension portion 204.

Likewise, the second extension portion 208 of the bassinet 200 is pulled outwards around the second lateral top edge, i.e., the second lateral rod 118 wrapped with the fabric body 150, of the playpen 100, so that it extends downwards in parallel with the second lateral outer fabric side of the playpen 100 until the five snap button male members provided on the second extension portion 208 face the five snap button female members provided on the second lateral outer fabric side. Then, the five snap button male members of the bassinet 200 can be engaged with the five snap button female members of the playpen 100. By such engagement, the second lateral side of the main body 210 of the bassinet 200 is suspended from the second lateral top edge of the playpen 100 thorough the second extension portion 208.

Lastly, the bottom plate 240 of the bassinet 200 is placed on the bottom 230 of the main body 210 of the bassinet 200, which is received within a space defined by the rods 112, 114, 116 and 118 of the playpen 100, to thereby complete the mounting operation of suspending the bassinet 200 from the top of the playpen 100.

From the above description of the preferred embodiment of the baby playpen-bassinet combination according to the present invention, it can be seen that the bassinet can be safely and stably suspended from the top of the playpen by the supporting rods, the coupling members and the snap buttons which are inexpensive to manufacture. Of course, it will be apparent to those skilled in the art from this disclosure that the provisions of the snap button male and female members may be interchanged. That is, the bassinet is provided with snap button female members while the playpen is provided with snap button male members. It is also apparent to those skilled in the art from the disclosure that any other known connecting structure which is inexpensive to manufacture may be used to replace the snap buttons. For example, buckles may be used instead of the snap buttons. In addition, locations of the vertically extending rib in the corner block and the vertically extending groove in the second portion of the coupling member need not be as illustrated and described above. The rib and the groove may be provided at other locations as long as they engage each other when the coupling member is inserted into the vertical hole. Moreover, the second portion of the coupling member need not be provided with the resilient portion and the pressing portion. The second portion of the coupling member may be a simple cylindrical portion with a vertically extending groove as long as it can be smoothly inserted into and removed from the vertical hole.

Hence, while only one embodiment has been chosen to illustrate the present invention, it will be apparent to those skilled in the art from this disclosure that various changes and modifications can be made herein without departing from the scope of the invention as defined in the appended claims. Furthermore, the forgoing description of the preferred embodiment according to the present invention is provided for illustration only, and not for the purpose of limiting the invention as defined by the appended claims and their equivalents.

What is claimed is:

1. A baby playpen-bassinet combination comprising:

a playpen comprising:

an upper frame including two horizontal longitudinal rods parallel to each other, two horizontal lateral rods parallel to each other and perpendicular to said two longitudinal rods and four corner blocks each fixedly connecting one of said two longitudinal rods and one of said two lateral rods, wherein each of said four corner blocks is provided with a vertical hole and a vertically extending rib radially inwardly protruded from the wall of said vertical hole;

a supporting frame fixedly connected to said four corner blocks of said upper frame;

a bottom frame fixedly connected to said supporting frame; and a fabric body wrapping around said two longitudinal rods, said two lateral rods and said supporting frame so as to form a peripheral surface of said playpen and cover said bottom frame, wherein said peripheral surface includes two lateral outer fabric sides extending downwards from said two lateral rods, respectively, and provided with first connecting means, respectively; and a bassinet detachably mounted onto said upper frame of said playpen, comprising:

a main body received within a space defined by said two longitudinal rods and said two lateral rods of said playpen, wherein said main body includes two longitudinal sides parallel to each other, two lateral sides parallel to each other and perpendicular to said two longitudinal dies and a bottom;

two suspension sleeves connected to said two longitudinal sides of said main body so as to extend longitudinally, respectively;

two extension portions connected to said two lateral sides of said main body so as to extend therefrom, respectively, and provided with second connecting means engageable with said first connecting means of said playpen, respectively, wherein said two extension portions extend around said two lateral rods of said playpen, respectively, so as to be fixedly connected to said two lateral outer fabric sides of said peripheral surface of said playpen, respectively, through engagement between said first and second connecting means;

two supporting rods each having two hollow end portions and passing through said two suspension sleeves, respectively, so that said two hollow end portions of each of said two supporting rods are protruded outside of said sleeve;

four coupling members each having a horizontally extending first portion to be inserted into said hollow end portion of said supporting rod, and a vertically extending second portion integrally formed with and extending downwards from an end of said first portion and having a radially inwardly recessed groove vertically extending upwards from a bottom thereof, wherein said second portion is adapted to be inserted into said vertical hole in said corner block of said playpen with said vertically extending groove engaging said vertically extending rib in said corner block so that each supporting rod is supported on two corner blocks; and a bottom plate placed on said bottom of said main body.

2. A baby playpen-bassinet combination according to claim 1 wherein said vertically extending rib and said vertically extending groove are located such that said vertically extending rib engages said vertically extending groove in a plane formed by said first and second portions of said coupling member when said second portion of said coupling member is inserted into said vertical hole in said corner block.

3. A baby playpen-bassinet combination according to claim 2 wherein said vertically extending groove is provided in said second portion of said coupling member on the same side as said first portion, said second portion of said coupling member further comprises an resilient portion connected to the bottom of said second portion on an opposite side to said first portion and extending upwards from the bottom of said second portion in parallel with said second portion, and said resilient portion is provided at a top thereof with a pressing portion obliquely extending to a level higher than that of said first portion so that pressing said pressing portion of said resilient portion causes said resilient portion to move towards said second portion of said coupling member, thereby facilitating the removal of said coupling member from said vertical hole.

4. A baby playpen-bassinet combination according to claim 1 wherein said first portion of said coupling member comprises an insertion portion to be inserted into said hollow end portion of said supporting rod, and an abutment portion to abut against the rim of an end face of said hollow end portion when said insertion portion is inserted into said hollow end portion.

5. A baby playpen-bassinet combination according to claim 1 wherein said first connecting means comprises a plurality of snap button female members, and wherein said second connecting means comprises a plurality of snap button male members.

6. A baby playpen-bassinet combination according to claim 5 wherein said plurality of snap button female members and said plurality of snap button male members are laterally linearly aligned.

7. A baby playpen-bassinet combination according to claim 1 wherein said first connecting means comprises a plurality of snap button male members, and wherein said second connecting means comprises a plurality of snap button female members.

8. A baby playpen-bassinet combination according to claim 7 wherein said plurality of snap button male members and said plurality of snap button female members are laterally linearly aligned.

9. A baby playpen-bassinet combination according to claim 1 wherein each of said four corner blocks comprises a longitudinal portion for fixedly connecting said horizontal longitudinal rod, a lateral portion for fixedly connecting said horizontal lateral rod and a protruded portion integrally inwardly protruded between a lower portion of said longitudinal portion and a lower portion of said lateral portion, and wherein said vertical hole is provided in said protruded portion.

10. A baby playpen-bassinet combination according to claim 1 wherein said vertical hole is a blind hole, and said vertically extending rib is integrally formed with a bottom portion of said vertical hole and extends upwards from said bottom portion of said vertical hole to be at least flush with a top edge of the wall of said vertical hole.

11. A baby playpen-bassinet combination according to claim 1 wherein said vertical hole is a through hole, and said vertically extending rib extends upwards from a bottom edge of the wall of said vertical hole to be al least flush with a top edge of the wall of said vertical hole.

12. A baby playpen-bassinet combination according to claim 1 wherein each of said two supporting rods is formed by connecting two or more supporting rod sections.

13. A baby playpen-bassinet combination according to claim 1 wherein said main body, said two suspension sleeves and said two extension portions of said bassinet are integrally formed by stitching a fabric.

14. A baby playpen-bassinet combination according to claim 1 wherein said corner blocks are formed from plastic or metal material, wherein said supporting rods are formed from metal material and wherein said coupling members are formed from plastic material.

* * * * *